US007743751B2

(12) United States Patent
Yonemoto

(10) Patent No.: US 7,743,751 B2
(45) Date of Patent: Jun. 29, 2010

(54) FUEL FEED APPARATUS

(75) Inventor: Toshiyuki Yonemoto, Nagoya (JP)

(73) Assignee: Denso Corporation, Kariya (JP)

( * ) Notice: Subject to any disclaimer, the term of this patent is extended or adjusted under 35 U.S.C. 154(b) by 48 days.

(21) Appl. No.: 12/335,753

(22) Filed: Dec. 16, 2008

(65) Prior Publication Data

US 2009/0165752 A1 Jul. 2, 2009

(30) Foreign Application Priority Data

Dec. 27, 2007 (JP) ..... 2007-335910

(51) Int. Cl.
*F02M 37/04* (2006.01)
*F02M 1/16* (2006.01)

(52) U.S. Cl. ..... 123/514; 123/179.11

(58) Field of Classification Search ..... 123/509, 123/510, 511, 512, 514, 516, 179.9, 179.11, 123/179.16, 179.17; 210/416.4
See application file for complete search history.

(56) References Cited

U.S. PATENT DOCUMENTS

| | | | | |
|---|---|---|---|---|
| 4,320,734 | A * | 3/1982 | Balachandran | 123/510 |
| 4,491,120 | A * | 1/1985 | Hodgkins | 123/557 |
| 4,491,143 | A * | 1/1985 | Yasuhara | 137/172 |
| 4,984,554 | A * | 1/1991 | Ariga et al. | 123/516 |
| 5,664,532 | A * | 9/1997 | August | 123/179.11 |
| 5,839,413 | A * | 11/1998 | Krause et al. | 123/447 |
| 6,328,883 | B1 * | 12/2001 | Jensen | 210/136 |
| 6,701,900 | B1 * | 3/2004 | Millar et al. | 123/516 |
| 6,964,267 | B2 * | 11/2005 | Jin | 123/514 |
| 7,343,901 | B2 | 3/2008 | Mori et al. | |
| 7,527,043 | B2 * | 5/2009 | Burkitt | 123/510 |
| 7,594,499 | B2 * | 9/2009 | Suzuki et al. | 123/446 |
| 7,634,986 | B2 * | 12/2009 | Kuroda et al. | 123/457 |
| 2009/0145402 | A1 * | 6/2009 | Sano | 123/447 |

FOREIGN PATENT DOCUMENTS

| | | |
|---|---|---|
| JP | 51-58214 | 5/1976 |
| JP | 51-21226 | 6/1976 |
| JP | 59-7265 | 1/1984 |
| JP | 4-27159 | 3/1992 |
| JP | 2002-371937 | 12/2002 |
| JP | 2003-293904 | 10/2003 |

OTHER PUBLICATIONS

Japanese Office Action dated Oct. 20, 2009, issued in corresponding Japanese Application No. 2007-335910, with English translation.

* cited by examiner

*Primary Examiner*—Thomas N Moulis
(74) *Attorney, Agent, or Firm*—Nixon & Vanderhye PC

(57) ABSTRACT

A feed pump pumps fuel from a fuel tank. A filter portion includes a filter element for removing foreign matter contained in the fuel discharged from the feed pump. A high-pressure pump pumps the filtered fuel to the internal combustion engine. A return passage is connected with a passage between the filter element and the high-pressure pump for partially returning the filtered fuel to the fuel tank. A priming pump portion has an inlet port, which is connected with the return passage, and an outlet port, which is connected with the filter element. The priming pump portion draws fuel from the fuel tank to supply the fuel to the filter element when being operated.

10 Claims, 3 Drawing Sheets

FUEL FEED APPARATUS

CROSS REFERENCE TO RELATED APPLICATIONS

This application is based on and incorporates herein by reference Japanese Patent Application No. 2007-335910 filed on Dec. 27, 2007.

FIELD OF THE INVENTION

The present invention relates to a fuel feed apparatus configured to pump fuel from a fuel tank to an internal combustion engine outside the fuel tank.

BACKGROUND OF THE INVENTION

For example, U.S. Pat. No. 7,343,901 B2 (JP-A-2006-207499) proposes a fuel feed apparatus configured to pump fuel from a fuel tank to an internal combustion engine outside the fuel tank. The present fuel feed apparatus includes a feed pump, a filter portion, and a high-pressure pump. The feed pump pumps fuel from the fuel tank. The filter portion includes a filter element for removing foreign matter contained in the fuel discharged from the feed pump. The high-pressure pump draws the fuel filtered through the filter portion and pressurizes the fuel to discharge the pressurized fuel to the internal combustion engine. The fuel feed apparatus disclosed in U.S. Pat. No. 7,343,901 B2 includes a priming pump. The priming pump is used for pumping fuel from the fuel tank and supplying the fuel to the filter element, which is for filtering fuel discharged from the feed pump, in order to vent air contained in the filter element after the filter element is exchanged. However, the priming pump is provided midway through the passage upstream of the feed pump. Therefore, a bypass passage and a check valve are provided only for a priming operation using the priming pump. The bypass passage is used for supplying fuel pumped from the priming pump to the filter element so as to bypass the feed pump. The check valve is used for restricting counterflow of fuel. In the present structure, the fuel circuit may be complicated due to providing of the bypass passage only for the priming operation, and consequently flexibility of a layout of a fuel circuit of the fuel feed apparatus may be impaired.

SUMMARY OF THE INVENTION

In view of the foregoing and other problems, it is an object of the present invention to produce a fuel feed apparatus having a simplified fuel circuit, which is enhanced in flexibility of a layout.

According to one aspect of the present invention, a fuel feed apparatus for pumping fuel from a fuel tank to an internal combustion engine, the fuel feed apparatus comprises a feed pump configured to pump fuel from the fuel tank. The fuel feed apparatus further comprises a filter portion including a filter element configured to remove foreign matter contained in fuel pumped from the feed pump. The fuel feed apparatus further comprises a high-pressure pump configured to pump fuel filtered through the filter portion to the internal combustion engine. The fuel feed apparatus further comprises a return passage connected with a passage portion between the filter element and the high-pressure pump and configured to partially return the fuel filtered through the filter element to the fuel tank. The fuel feed apparatus further comprises a priming pump portion having an inlet port, which communicates with the return passage, and an outlet port, which is connected with the filter element, and configured to pump fuel from the fuel tank to the filter element.

BRIEF DESCRIPTION OF THE DRAWINGS

The above and other objects, features and advantages of the present invention will become more apparent from the following detailed description made with reference to the accompanying drawings. In the drawings.

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
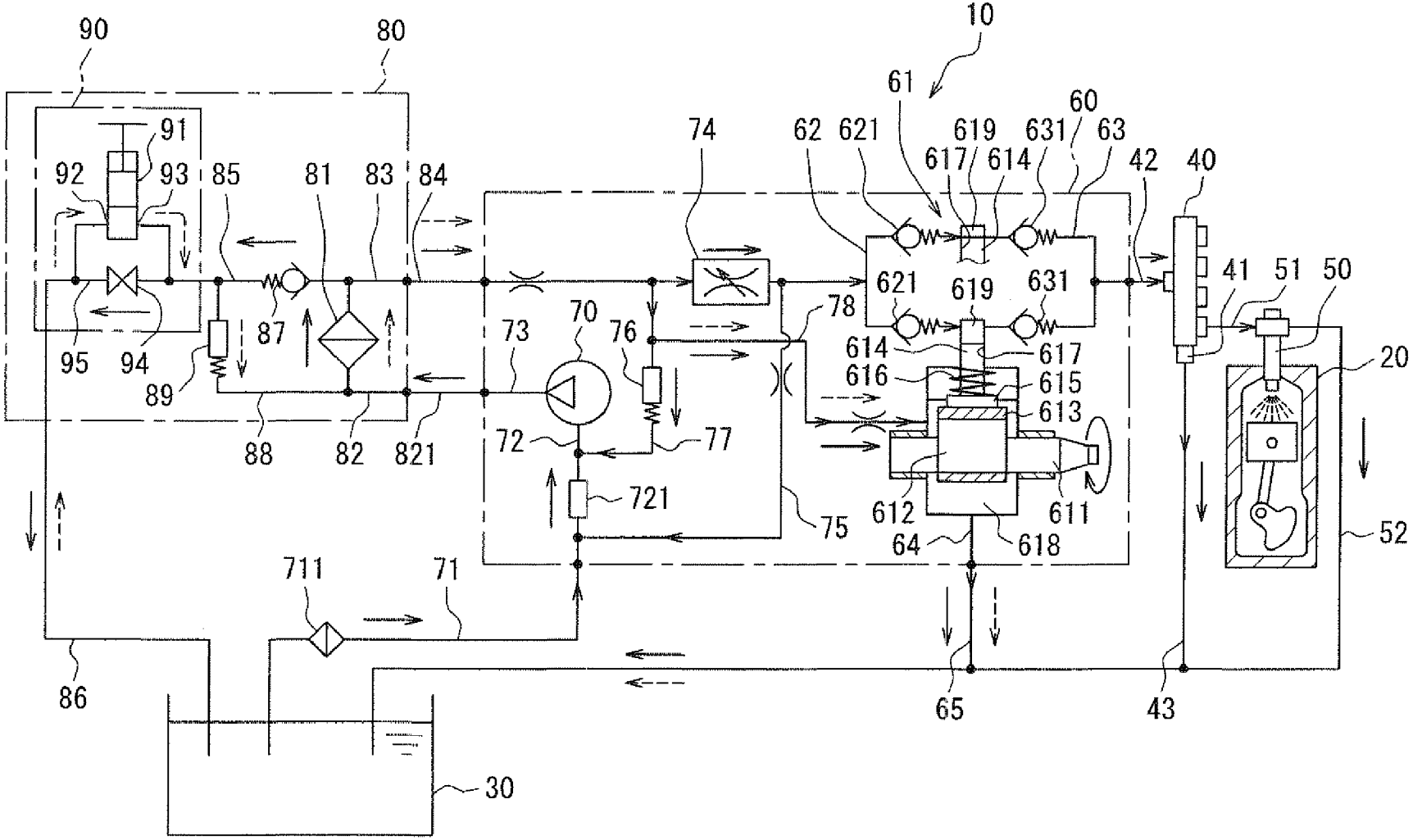
FIG. 1 is a schematic view showing a fuel feed apparatus according to a first embodiment.

As follows, multiple embodiments will be described with reference to drawings. FIG. 1 depicts a fuel feed apparatus according to the first embodiment. FIG. 1 is a schematic view showing a fuel feed apparatus 10. The fuel feed apparatus 10 according to the present embodiment is, for example, used for a four-cylinder internal combustion engine 20 such as a diesel engine. The fuel feed apparatus 10 supplies fuel from a fuel tank 30 to each combustion chamber of the engine 20. The fuel feed apparatus 10 is controlled by a control device such as an electronic control unit (ECU, not shown). As shown in FIG. 1, the fuel feed apparatus 10 includes a common rail 40, an injector 50, a pump portion 60, a filter portion 80, and the like.

The common rail 40 accumulates high-pressure fuel, which is supplied from the pump portion 60, at target rail pressure. The target rail pressure is set by the ECU based on an operation state such as an accelerator position and an engine speed of the engine 20. The common rail 40 is provided with a pressure limiter 41, which opens so as to release pressure of fuel accumulated in the common rail 40 when the pressure becomes greater than a predetermined upper limit. The pressure limiter 41 is connected with a fuel pipe 43, which communicates with the fuel tank 30. When the pressure limiter 41 opens, fuel returns from the common rail 40 to the fuel tank 30 through the fuel pipe 43.

The injector 50 is provided to each cylinder for injecting fuel, which is supplied from the common rail 40, into each combustion chamber of the engine 20. The injector 50 is connected with the common rail 40 through a high-pressure pipe 51. The ECU controls an injection timing and an injection quantity of fuel of the injector 50. The injector 50 is connected with a fuel pipe 52, which communicates with the fuel tank 30. Fuel is supplied from the common rail 40 to the injector 50, and the supplied fuel is not partially injected and returned as surplus to the fuel tank 30 through the fuel pipe 52.

The pump portion 60 draws fuel from the fuel tank 30 and pressurizes the drawn fuel. The pump portion 60 press-feeds the pressurized fuel to the common rail 40 through a fuel pipe 42, which is connected with the common rail 40. The pump portion 60 includes a high-pressure pump 61, a feed pump 70, an inlet metering valve 74, a pressure regulator 76, and the like.

The high-pressure pump 61 includes a camshaft 611 and plungers 614. The camshaft 611 rotates by receiving driving force of a crankshaft (not shown) of the engine 20. The plungers 614 are actuated by the camshaft 611, thereby reciprocally moving inside a cylinder 617. The high-pressure pump 61 draws fuel and pressurizes the fuel in response to the reciprocal movement of each of the plungers 614 to supply the pressurized fuel to the common rail 40. Two of the plungers 614 are opposed to each other in the radial direction of the camshaft 611 for alternately draw and pressurize fuel.

The camshaft 611 and the plungers 614 are accommodated in a pump housing (not shown). The camshaft 611 has a cam 612, which is rotated with the camshaft 611. The cam 612 is accommodated in a cam chamber 618, which is provided in the pump housing. The outer circumferential periphery of the cam 612 is fitted with a cam ring 613 via a metal bush, and the cam ring 613 is rotatable.

Each of the plungers 614 is supported by the cylinder 617 and axially movable in the pump housing. Each of the plungers 614 has an end at the side of the camshaft 611, and the end is integrally provided with a tappet 615. The tappet 615 is biased by a spring 616 toward the outer circumferential periphery of the cam ring 613. In the present structure, the cam 612 eccentrically rotates in response to rotation of the camshaft 611, and the eccentric rotation of the cam 612 is converted to a linear motion via the cam ring 613. Thus, the linear motion of the cam ring 613 is transmitted to the tappet 615, and thereby the plunger 614 moves back and forth inside the cylinder 617.

The cylinder 617 therein defines a compression chamber 619, which variably changes in volume correspondingly to the axial movement, i.e., reciprocal movement of the plunger 614. The compression chamber 619 is connected with an inlet passage 62 and an outlet passage 63.

An inlet passage 65*a* is provided with an inlet valve 621, which opens when fuel flows into the compression chamber 619. The outlet passage 63 is provided with an outlet valve 631, which opens when fuel flows out of the compression chamber 619. The fuel pipe 42 is connected with the outlet passage 63, which is connected with the common rail 40.

As the plunger 614 moves toward the camshaft 611 in the cylinder 617, the compression chamber 619 increases in volume and decreases in pressure. Whereby, fuel supplied from the feed pump 70 to the inlet passage 62 pushes to open the inlet valve 621, thereby the fuel is drawn into the compression chamber 619. Alternatively, as the plunger 614 moves away from the camshaft 611 in the cylinder 617, the compression chamber 619 decreases in volume, thereby pressurizing the fuel in the compression chamber 619. When fuel pressure becomes greater than valve-opening pressure, fuel in the compression chamber 619 pushes and opens the outlet valve 631, and thereby the fuel is discharged from the outlet passage 63 to the common rail 40.

The feed pump 70 is, for example, a generally-known trochoid pump. The feed pump 70 and the high-pressure pump 61 are accommodated in the pump housing. The feed pump 70 is actuated by the camshaft 611, thereby pumping fuel from the fuel tank 30 to the high-pressure pump 61 through a fuel pipe 71. The fuel pipe 71 is provided with a prefilter 711 for removing foreign matter contained in fuel. The inlet of the feed pump 70 is connected with an inlet passage 72, which is connected with the fuel pipe 71. The inlet passage 72 is provided with a gauze filter 721 for removing foreign matter contained in fuel flowing downstream of the prefilter 711. The outlet of the feed pump 70 is connected with an outlet passage 73 for supplying fuel from the feed pump 70 to a filter portion 80.

The inlet metering valve 74 is a solenoid valve provided to the inlet passage 62. The ECU controls a valve-opening area of the inlet metering valve 74 on the basis of the operation state of the engine 20. The ECU manipulates the valve-opening area of the inlet metering valve 74, thereby controlling quantity of fuel drawn into the compression chamber 619 of the high-pressure pump 61. A fuel passage 75 is connected to the downstream of the inlet metering valve 74 for returning fuel, which leaks when the inlet metering valve 74 closes, to the upstream of the gauze filter 721.

The pressure regulator 76 is provided in a fuel passage 77, which connects the inlet of the feed pump 70 with the outlet of the feed pump 70, for controlling pressure of fuel discharged from the feed pump 70 not to exceed predetermined pressure. The pressure regulator 76 accommodates a piston, which is movable according to pressure of fuel discharged from the feed pump 70 (not shown). When discharge pressure of the feed pump 70 exceeds the predetermined pressure, the piston opens the passage in the pressure regulator 76 to return the discharged fuel to the inlet of the feed pump 70. The upstream end of the fuel passage 77 is connected with the inlet passage 62 located upstream of the inlet metering valve 74. The downstream end of the fuel passage 77 is connected with the inlet passage 72 located between the gauze filter 721 and the feed pump 70.

The fuel passage 77 is connected with a fuel passage 78, which communicates the upstream of the pressure regulator 76 with the cam chamber 618. Fuel discharged from the feed pump 70 is partially supplied as lubricant to the cam chamber 618 through the fuel passage 78. Fuel supplied to the cam chamber 618 lubricates the cam 612, the plunger 614, and the like, and thereafter the fuel returns to the fuel tank 30 after passing through a fuel passage 64 and a fuel pipe 65. Components such as a valve configured to restrict circulation of fuel is not provided in the fuel passage 78, the cam chamber 618, the fuel passage 64, and the fuel pipe 65. Therefore, fuel regularly flows in the passages during an operation of the fuel feed apparatus 10.

The filter portion 80 is provided between the feed pump 70 and the high-pressure pump 61 for removing foreign matter contained in fuel, which is discharged from the feed pump 70 and supplied to the high-pressure pump 61. The filter portion 80 includes a filter element 81, a priming pump portion 90, and the like. The filter element 81 is, for example, formed of a nonwoven fabric or the like and excellent in removability of foreign matter compared with the prefilter 711 and the gauze filter 721. The inlet (upstream) of the filter element 81 is connected with a fuel passage 82, which communicates with the outlet passage 73 of the feed pump 70. The outlet (downstream) of the filter element 81 is connected with a fuel passage 83, which is for supplying fuel to the inlet passage 62 of the high-pressure pump 61. The downstream of the fuel passage 83 is connected with a fuel pipe 84, which is connected with the inlet passage 62 of the high-pressure pump 61.

The fuel passage 83 is connected with a discharge passage 85, which is for exhausting fuel filtered through the filter element 81 to the fuel tank 30 outside the filter portion 80. The discharge passage 85 is connected with an exhaust pipe 86 for returning fuel from the discharge passage 85 to the fuel tank 30.

The discharge passage 85 is provided with a first relief valve 87, which opens when fuel pressure in the fuel passage 83 exceeds predetermined pressure. The first relief valve 87 opens, thereby partially returns fuel, which is filtered through the filter element 81, to the fuel tank 30 through the discharge passage 85 and the exhaust pipe 86. The discharge passage 85 and the exhaust pipe 86 define a return passage. The discharge passage 85 and the exhaust pipe 86 are configured to exhaust air, which is contained in fuel filtered through the filter element 81, and discharge the air with fuel. Further, the first relief valve 87 is provided in the discharge passage 85, and therefore fuel pressure in the fuel passage 83 can be maintained at pressure greater than predetermined pressure. The first relief valve 87 is configured to open when fuel pressure in the fuel passage 83 becomes greater than predetermined pressure so as to return fuel to the fuel tank 30. Therefore, the filter element 81 can be protected from excessive fuel pressure.

The priming pump portion 90 is provided in the discharge passage 85. The priming pump portion 90 is used for pumping fuel from the fuel tank 30 and thereby pushing air from the filter element 81 out of the fuel feed apparatus 10. The present operation of the priming pump portion 90 is performed, for example, after exchanging the filter element 81. The priming pump portion 90 includes a pump main body 91, a valve 94, and the like. The pump main body 91 has an inlet port 92, which is connected with an inlet branch point of the discharge passage 85. The pump main body 91 has an outlet port 93, which is connected with an outlet branch point of the discharge passage 85. The outlet branch point is closer to the filter element 81 than the inlet branch point which is connected with the inlet port 92 of the pump main body 91. The pump main body 91 is, for example, a generally-known volume-type piston pump (positive-displacement piston pump). The pump main body 91 is configured to draw fuel from the inlet port 92 and discharge the drawn fuel though the outlet port 93, when a piston (not shown) is manually moved back and forth along a cylinder so as to alter an inner volume communicating with the inlet port 92 and the outlet port 93.

The valve 94 is provided midway through a communication passage 95. The communication passage 95 is provided in the discharge passage 85 to bypasses the pump main body 91. The valve 94 is a manual valve configured to control communication in the communication passage 95 when being manually operated. The valve 94 is opened in a normal operating condition, in which the engine 20 is operated. The valve 94 is closed in a priming operation, in which the pump main body 91 is actuated.

The discharge passage 85 is connected with a priming passage 88. The priming passage 88 communicates a portion of the discharge passage 85 between the priming pump portion 90 and the first relief valve 87 with the fuel passage 82. Fuel fed from the pump main body 91 is supplied to the upstream of the filter element 81 through the discharge passage 85. The priming passage 88 is provided with a second relief valve 89, which opens when fuel pressure at the side of the pump main body 91 exceeds predetermined pressure. When fuel pressure in the discharge passage 85 exceeds valve opening pressure of the second relief valve 89 in response to actuation of the pump main body 91, fuel is supplied to the upstream of the filter element 81 through the priming passage 88.

As above, the structure of the fuel feed apparatus 10 according to the present embodiment is described. Next, an operation and an operation effect of the fuel feed apparatus 10 will be described. The operation of the fuel feed apparatus 10 will be described separately with regard to a normal operating condition, in which the engine 20 operates, and a priming operation, in which air accumulating in the filter element 81 is vent after exchanging of the filter element 81, for example.

(Normal Operation)

First, the normal operation of the fuel feed apparatus 10 when the engine 20 operates will be described. A flow direction of fuel, which circulates through the fuel circuit in the normal operation, is indicated by the solid arrows in FIG. 1.

When the engine 20 operates, the feed pump 70 and the high-pressure pump 61 are operated by receiving driving force from the crankshaft. Fuel is drawn from the fuel tank 30 through the fuel pipe 71 in response to the operation of the feed pump 70. The drawn fuel passes through the prefilter 711 and flows into the inlet passage 72. The fuel flows from the inlet passage 72 into the feed pump 70 through the gauze filter 721. Fuel discharged from the feed pump 70 passes through the outlet passage 73, a fuel pipe 821, and the fuel passage 82 and flows into the filter element 81. Fuel is discharged into the fuel passage 83 after passing through the filter element 81 and removed of foreign matter. Fuel flowing into the fuel passage 83 partially passes through the fuel pipe 84 and flows into the inlet passage 62 of the high-pressure pump 61. Here, fuel flowing out of the filter element 81 contains, for example, air caused when fuel is drawn from the fuel tank 30 through the fuel pipe 71 and bubbled, and air caused when passing through the filters 711, 721.

The fuel passage 83 is connected with the discharge passage 85, which communicates with the fuel tank 30. Therefore, air flowing from the filter element 81 is partially exhausted outside the fuel feed apparatus 10 through the discharge passage 85, without being supplied to the high-pressure pump 61. In the present condition, the valve 94 provided in the communication passage 95 opens. Therefore, fuel containing air returns to the fuel tank 30 after passing through the discharge passage 85, which branches from the fuel passage 83, the first relief valve 87, the communication passage 95, and the exhaust pipe 86. At this time, the second relief valve 89 is closed in response to operation of the feed pump 70. Therefore, fuel discharged from the feed pump 70 does not pass through the priming passage 88 and is not exhausted to the discharge passage 85 through the priming passage 88.

Fuel is metered. i.e. controlled in quantity through the inlet metering valve 74, and the metered fuel is drawn into the compression chamber 619 of the high-pressure pump 61 after passing though the inlet passage 62 of the high-pressure pump 61. The fuel drawn into the compression chamber 619 is pressurized as the plunger 614 moves away from the camshaft. When pressure of the pressurized fuel exceeds the valve opening pressure of the outlet valve 631, fuel pushes and opens the outlet valve 631. The flows into the common rail 40 after passing through the outlet passage 63 and the fuel pine 42. Fuel flowing into the common rail 40 is injected from each injector 50 into each combustion chamber. Fuel is not partially injected, and the fuel returns from the fuel pipe 52 to the fuel tank 30.

Fuel passing through the inlet passage 62 partially flows into the fuel passage 77. When fuel pressure upstream of the inlet metering valve 74 in the inlet passage 62 exceeds predetermined pressure, the pressure regulator 76 opens, and fuel partially returns to the upstream of the feed pump 70. Fuel flowing into the fuel passage 77 partially flows into the cam chamber 618 after passing through the fuel passage 78. Fuel flowing into the cam chamber 618 lubricates the cam 612, the plunger 614, and the like, and thereafter the fuel returns to the fuel tank 30 after passing through the fuel passage 64 and the fuel pipe 65. The fuel passage from the fuel passage 77 to the fuel pipe 65 is equivalent to a lubricating passage.

(Priming Operation)

Next, an operation of the fuel feed apparatus 10 when the priming operation is carried out will be described. The priming operation is carried out, for example, after exchanging the filter element 81 of the filter portion 80. A flow direction of fuel, which circulates through the fuel circuit in the priming operation, is indicated by the dotted arrows in FIG. 1.

The priming is carried out by actuating the priming pump portion 90. In the condition, the engine 20 is stopped. Before beginning of the priming operation, the valve 94 is closed, and the communication passage 95 is blocked.

Next, the pump main body 91 is actuated. Fuel is drawn from the fuel tank 30 to the inlet port 92 of the pump main body 91 through the exhaust pipe 86 and the discharge passage 85 in response to the actuation of the pump main body 91. The fuel drawn by the pump main body 91 is press-fed, and thereby discharged to the filter element 81 through the outlet port 93. The fuel discharged from the outlet port 93 pushes and opens the second relief valve 89 and flows into the fuel passage 82 through the priming passage 88. In the present condition, fuel pressure in the discharge passage 85 is greater than fuel pressure in the fuel passage 83, and therefore the first relief valve 87 is closed. Accordingly, fuel discharged from the pump main body 91 is not supplied from the discharge passage 85 to the fuel passage 83 directly through the first relief valve 87.

The fuel flowing into the fuel passage 82 flows from the upstream of the filter element 81 to the downstream of the filter element 81. In the present operation, the flow direction of the fuel is the same as the flow direction of fuel in the normal operation. Therefore, even if foreign matter is contained in the fuel drawn by the pump main body 91, a clean side of the filter element 81 can be protected form such foreign matter. The clean side of the filter element 81 is located at the downstream of the filter element 81, i.e., at the side of the high-pressure pump 61. That is, such foreign matter can be restricted from being captured by the clean side of the filter element 81. Thus, foreign matter captured by the clean side of the filter element 81 can be restricted from flowing into the high-pressure pump 61 in the beginning of the normal operation after completing the priming operation. As fuel is supplied to the filter element 81, the fuel and air in the filter element 81 are discharged to the fuel passage 83. The fuel containing air is exhausted into the fuel passage 83, and the fuel flows into the inlet passage 62 through the fuel pipe 84. The inlet metering valve 74 is closed when the engine 20 stops, and therefore fuel flows from the inlet passage 62 into the cam chamber 618 after passing through the fuel passage 77 and the fuel passage 78. Fuel flowing into the cam chamber 618 returns to the fuel tank 30 after passing through the fuel passage 64 and the fuel pipe 65. The passage from the fuel passage 77, which branches from the inlet passage 62, to the fuel pipe 65 does not include an obstacle such as a valve. Therefore, fuel containing air can be returned to the fuel tank 30 in the priming operation, without additionally providing a passage and a pipe only for returning the fuel.

In the present embodiment, the priming pump portion 90 is provided in the discharge passage 85. Therefore, an additional component such as a passage and a pipe only for the priming operation described in the prior art need not be provided. According to present embodiment, the fuel circuit of the fuel feed apparatus 10 can be simplified. In addition, flexibility of a layout of the fuel circuit can be enhanced. Furthermore, the filter portion 80 defines a part of the discharge passage 85, which is connected to the filter element 81, and the priming passage 88. Therefore, a number of fuel pipes connected with the filter portion 80 can be reduced. Therefore, the fuel circuit outside the filter portion 80 can be simplified. In addition, flexibility of the layout of the fuel circuit can be enhanced. Furthermore, the filter portion 80 is integrally provided with the priming pump portion 90, in addition to the part of the discharge passage 85 and the priming passage 88. Therefore, the fuel circuit outside the filter portion 80 can be simplified. In addition, flexibility of the layout of the fuel circuit can be enhanced.

(Modification of First Embodiment)

Figure 2:
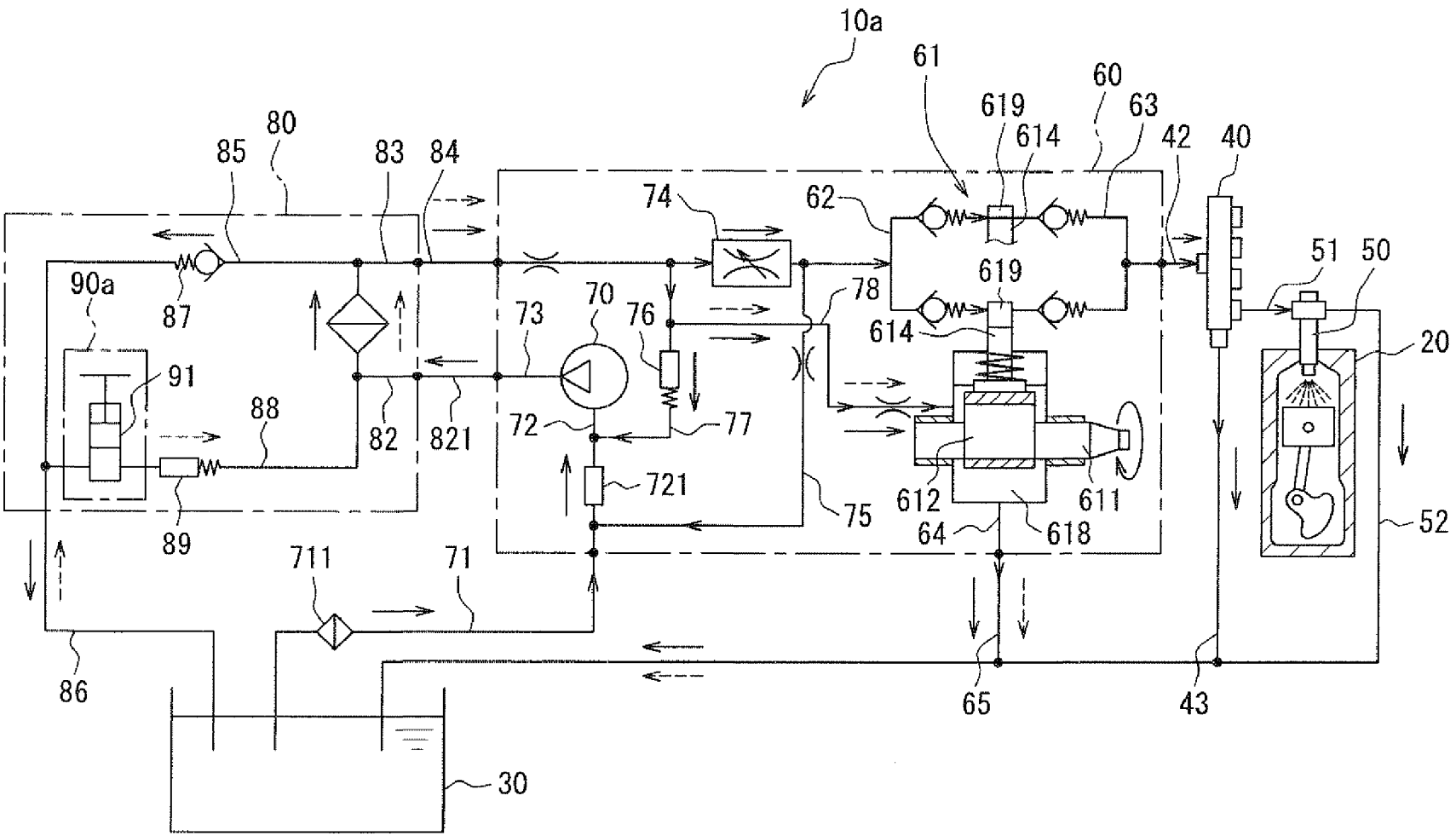
FIG. 2 is a schematic view showing a fuel feed apparatus according to a modification of the first embodiment.

FIG. 2 shows a modification of the fuel feed apparatus 10 according to the first embodiment shown in FIG. 1. In a fuel feed apparatus 11*a* in FIG. 2, the location of a priming pump portion 90*a* is different from that of the fuel feed apparatus 10 in FIG. 1. Specifically, the priming pump portion 90*a* is located in the priming passage 88 and closer to the fuel tank 30 than the second relief valve 89. In the present modification, the priming pump portion 90*a* need not be provided with the valve 94, dissimilarly to the priming pump portion 90 shown in FIG. 1. Even in the present structure, in which the priming pump portion 90*a* is provided at the present location, the same effect as that of the first embodiment can be produced.

Second Embodiment

Figure 3:
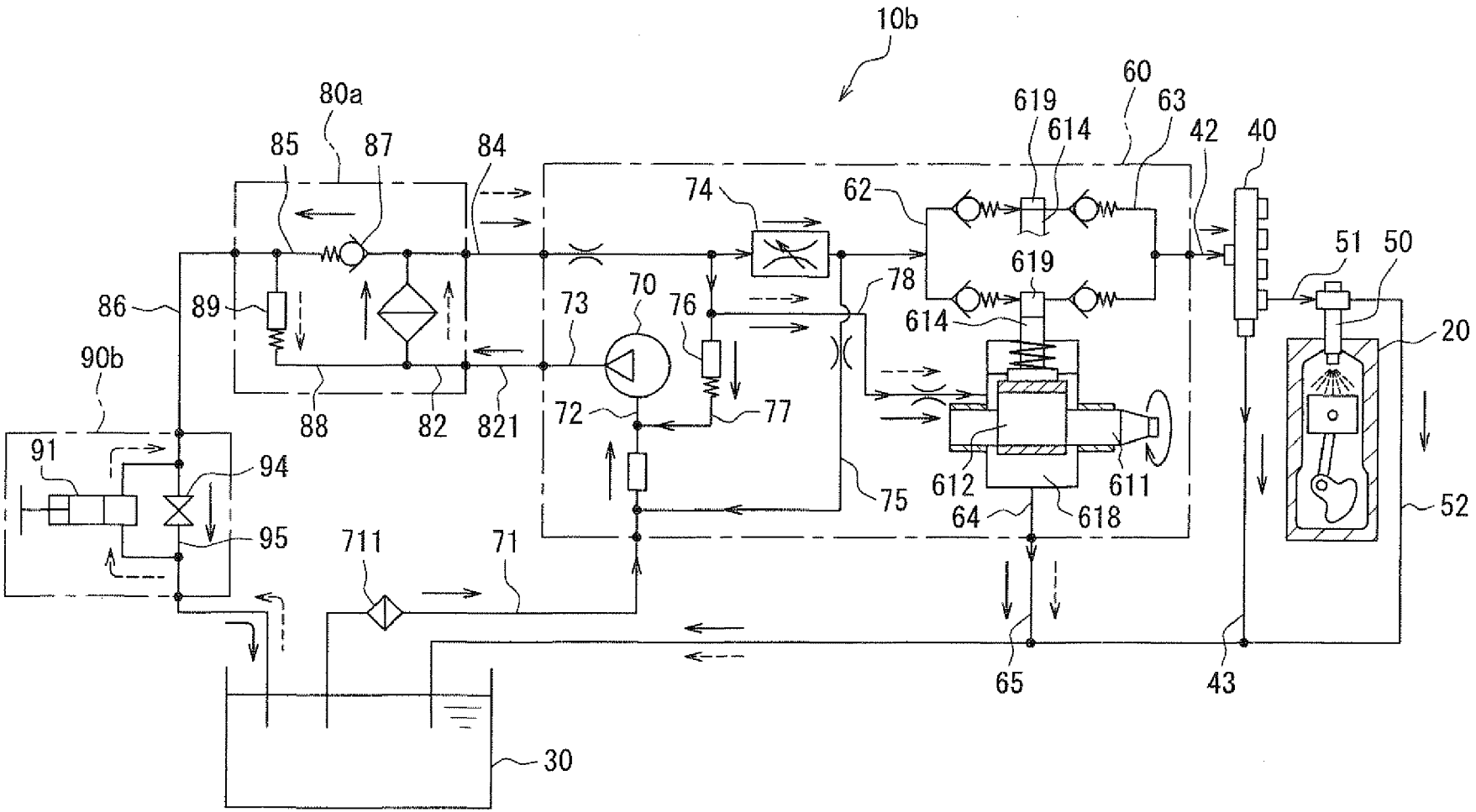
FIG. 3 is a schematic view showing a fuel feed apparatus according to a second embodiment.

FIG. 3 shows a fuel feed apparatus 10*b* according to the second embodiment. In the fuel feed apparatus 10*b* shown in FIG. 3, a priming pump portion 90*b* is provided in the exhaust pipe 86 and is not integrally provided with a filter portion 80*a*.

Other Embodiment

According to the first and second embodiments, the priming pump portions 90*a*, 90*b* provided in the fuel feed apparatus 10*a*, 10*b* have the manually operated structures. Alternatively, at least one of the priming pump portions 90*a*, 90*b* may be, for example, an in-line electric rotary pump or an in-tank type electric rotary pump accommodated in the fuel tank 30.

The number of the plungers may be arbitrary determined. For example, the plungers may include only one plunger.

In the above embodiments, each passage is a flow path, through which fuel flows, and includes a passage defined in a component such as a housing and a pipe connected with a housing, for example.

The above structures of the embodiments can be combined as appropriate. It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel feed apparatus for pumping fuel from a fuel tank to an internal combustion engine, the fuel feed apparatus comprising:

a feed pump configured to pump fuel from the fuel tank;

a filter portion including a filter element configured to remove foreign matter contained in fuel pumped from the feed pump;

a high-pressure pump configured to pump fuel filtered through the filter portion to the internal combustion engine;

a return passage connected with a passage portion between the filter element and the high-pressure pump and configured to partially return the fuel filtered through the filter element to the fuel tank; and a priming pump portion having an inlet port, which communicates with the return passage, and an outlet port, which is connected with the filter element, and configured to pump fuel from the fuel tank to the filter element.

2. The fuel feed apparatus according to claim 1, wherein the return passage is configured to return air, which is contained in the fuel filtered through the filter element, with the fuel to the fuel tank when the feed pump operates.

3. The fuel feed apparatus according to claim 1, wherein the outlet port of the priming pump portion is connected with the upstream of the filter element.

4. The fuel feed apparatus according to claim 1, further comprising:

a first relief valve provided in the return passage, wherein the first relief valve opens when fuel pressure in the passage portion between the filter element and the high-pressure pump increases to first predetermined pressure.

5. The fuel feed apparatus according to claim 4, further comprising:

a priming passage communicating a first portion of the return passage, which is closer to the fuel tank than the first relief valve, with an upstream of the filter element; and a second relief valve, which opens when fuel pressure at the inlet increases to second predetermined pressure, wherein the priming pump portion is located at one of a second portion of the return passage, which is closer to the fuel tank than the second relief valve, and the priming passage.

6. The fuel feed apparatus according to claim 5, wherein the filter portion defines a third portion of the return passage, which includes an end connected with a downstream of the filter element, and the priming passage.

7. The fuel feed apparatus according to claim 6, wherein the filter portion is integrated with the priming pump portion.

8. The fuel feed apparatus according to claim 1, wherein the high-pressure pump includes:

a cam rotatable by receiving driving force from a crankshaft of the internal combustion engine;

a plunger linearly movable in response to rotation of the cam and configured to pump the fuel flowing from the filter element; and a lubricating passage configured to partially guide the fuel filtered through the filter element for lubricating the cam and the plunger and configured to return the fuel to the fuel tank.

9. The fuel feed apparatus according to claim 8, further comprising:

a metering valve provided between the filter element and the high-pressure pump and configured to control fuel pumped by the high-pressure pump, wherein the lubricating passage branches from an upstream of the metering valve.

10. The fuel feed apparatus according to claim 1, wherein the priming pump portion is configured to pump fuel from the fuel tank through the return passage and a passage portion between the feed pump and the filter element into the filter element when being operated.

* * * * *